US007279853B2

(12) United States Patent
Chong

(10) Patent No.: US 7,279,853 B2
(45) Date of Patent: Oct. 9, 2007

(54) FLUORESCENT LAMP DIMMER CONTROL

(75) Inventor: Yong Chong, Mississauga (CA)

(73) Assignee: MaxLite - SK America, Inc., Pine Brook, NJ (US)

( * ) Notice: Subject to any disclaimer, the term of this patent is extended or adjusted under 35 U.S.C. 154(b) by 363 days.

(21) Appl. No.: 10/657,334

(22) Filed: Sep. 8, 2003
(Under 37 CFR 1.47)

(65) Prior Publication Data

US 2005/0088112 A1 Apr. 28, 2005

(51) Int. Cl.
*H05B 37/02* (2006.01)

(52) U.S. Cl. ..... 315/307; 315/291

(58) Field of Classification Search ..... 315/219, 315/224, 244, 291, 307, 209 R, 247, 272, 315/312, 320, DIG. 4
See application file for complete search history.

(56) References Cited

U.S. PATENT DOCUMENTS 3,746,923 A * 7/1973 Spira et al. ..... 315/291
3,997,820 A * 12/1976 Stefani ..... 361/820
4,388,563 A 6/1983 Hyltin ..... 315/291
4,926,097 A 5/1990 Taek ..... 315/307
5,315,214 A 5/1994 Lesea ..... 315/219
5,404,080 A 4/1995 Quazi ..... 315/209 R
5,463,286 A * 10/1995 D'Aleo et al. ..... 315/295
5,581,158 A 12/1996 Quazi ..... 315/224
5,604,411 A 2/1997 Venkitasubrahmanian et al. ..... 315/244
5,751,115 A * 5/1998 Jayaraman et al. ..... 315/225
5,821,669 A * 10/1998 Shin ..... 310/323.03
6,002,213 A * 12/1999 Wood ..... 315/307
6,031,749 A 2/2000 Covington et al. ..... 315/307
6,037,721 A * 3/2000 Lansing et al. ..... 315/295
6,133,696 A 10/2000 Tavares et al. ..... 315/291
6,188,177 B1 2/2001 Adamson et al. ..... 315/219
6,316,882 B1 11/2001 Choi et al. ..... 315/291
6,337,544 B1 1/2002 Wang et al. ..... 315/209 R
6,376,991 B1 * 4/2002 Sundaram et al. ..... 315/58
6,545,431 B2 4/2003 Hui et al. ..... 315/307
6,577,076 B2 6/2003 Li et al. ..... 315/291
6,580,230 B2 6/2003 Koncz et al. ..... 315/219
6,608,617 B2 * 8/2003 Hoffknecht et al. ..... 345/173

* cited by examiner

*Primary Examiner*—Douglas W. Owens
*Assistant Examiner*—Jimmy Vu
(74) *Attorney, Agent, or Firm*—Neal L. Slifkin; Thomas R. Fitzgerald

(57) ABSTRACT

A dimmer fixture has a ballast board 10, a main board 40 and switch 70. The ballast board and main board have no inductors so the fixture may be used for fluorescent and incandescent lamps. The ballast board 10 has two bridge circuits 14, 16 and two dc voltage regulators. A delay circuit 24 prevents the VCO 26 for operating for long enough to allow fluorescent lamps to warm up. The main board has four power MOSFETS or IGBTs. One of devices Q1 and Q2 is always on. One of devices Q3, Q4 completes the drive to the lamps. Control signals on ballast board 10 operate the power devices Q1-Q4.

12 Claims, 5 Drawing Sheets

FLUORESCENT LAMP DIMMER CONTROL

BACKGROUND

The present invention relates to energy conservation dimmers for use on fluorescent lamps.

Fluorescent lamps, like fluorescent lamps and sodium vapor lamps, are a common feature today in commercial, industrial and increasingly in residential applications. A typical fluorescent lamp requires about a third or less of the electrical power of an incandescent bulb to produce the same amount of light and generally has a longer working life than an incandescent bulb. The efficiency of fluorescent lamps makes them an obvious choice for reducing lighting costs.

Coupled with the increased demand for fluorescent lamps was the demand and development of light level control devices which would allow users to reduce light output and power consumption when maximum illumination from the lamps is not needed. Despite the numerous improvements that have been made to such dimming control devices, current dimming technology is still unable to efficiently match the reduced light output with a corresponding reduction in power consumption. As a result dimmed fluorescent lamps often use more power than is necessary to maintain light levels at less than maximum illumination.

A significant period of inefficient power use occurs during the initial startup of the lamp. Generally fluorescent lamps require time to warm up before they reach full effectiveness. If the illumination is set to less than maximum during this time, the lamp will take longer to heat up and will use more power to do so. This limitation has been recognized in the prior art which have put forward several solutions to this problem, but generally circumvent the problem by inhibiting the dimming control during the lamp start-up phase. However, there are further energy-saving control steps that may be taken.

Prior art dimmer controls and ballast were often large circuits or systems. Multiple lamps were controlled by a central processor because the electronic circuitry for controlling an individual lamp was large and expensive. Many systems used microprocessors to control the lamps. Prior art systems also used inductors to limit the current in the lamps. Fluorescent lamps are negative resistance devices. Once they turn on, their resistance decreases. In order to limit the current in the lamp circuit other use inductors. But inductors are inefficient and waste power through heat.

Electronic ballast operates at a high frequency of 20-60 kHz whereas the conventional magnetic ballast operates at 50/60 Hz. The high frequency operation of the fluorescent lamp improves the efficiency by approximately 10 percent because of the increase in phosphor excitation. Flicker is also eliminated. Instant start is possible even at low supply voltage. Lamp life time is hence extended because coating of the filament can last longer.

Electronic ballasts operate at frequencies in the range of tens of kHz. By controlling the frequency, the power applying to the lamp is varied and hence the luminous output can be adjusted. Dimmable electronic ballast uses a low DC voltage or a rheostat to adjust the light output. It is typical to dim a lamp down to about 10 percent of its full brightness.

The present invention seeks to reduce the inefficiency of dimming control of fluorescent lamps by providing a more effective energy saving dimming control circuit. The invention also provides a relatively small control circuit that may fit into a standard two gang electrical junction box that is commonly used to hold an electrical receptacle or switch.

SUMMARY

The invention has a power supply that feeds two full wave bridge rectifiers. One bridge is connected to a first voltage regulator that supplies a first trigger. The other bridge supplies a second voltage regulator that provides power to an automatic voltage regulation (AVR) circuit. The AVR supplies regulated voltage to a delay circuit a voltage controlled oscillator (VCO), and a second trigger circuit. The second trigger circuit has its output coupled to the first trigger circuit through an opto-coupler. Each trigger circuit drives a pair of power devices such as MOSFETs or IGBTs.

In operation, the delay circuit keeps the VCO off for a predetermined amount of time, approximately four minutes. That time delay allows the power devices to run at full power and heat up the fluorescent lamp(s). After the lamp(s) are warm, the delay times out and the VCO controls operation. Variable resistors control the voltage across the oscillator to provide a pulse width modulated signal with variable duty cycle to the trigger circuits. The trigger circuits control the power to the MOSFETs or IGBTs and no inductors are needed. Because the circuitry is simple and does not require a microprocessor, the entire control circuit and the light switch may be integrated into a single device that installs in a standard two gang junction box.

DESECRIPTION OF THE FIGURES

Figure 1:
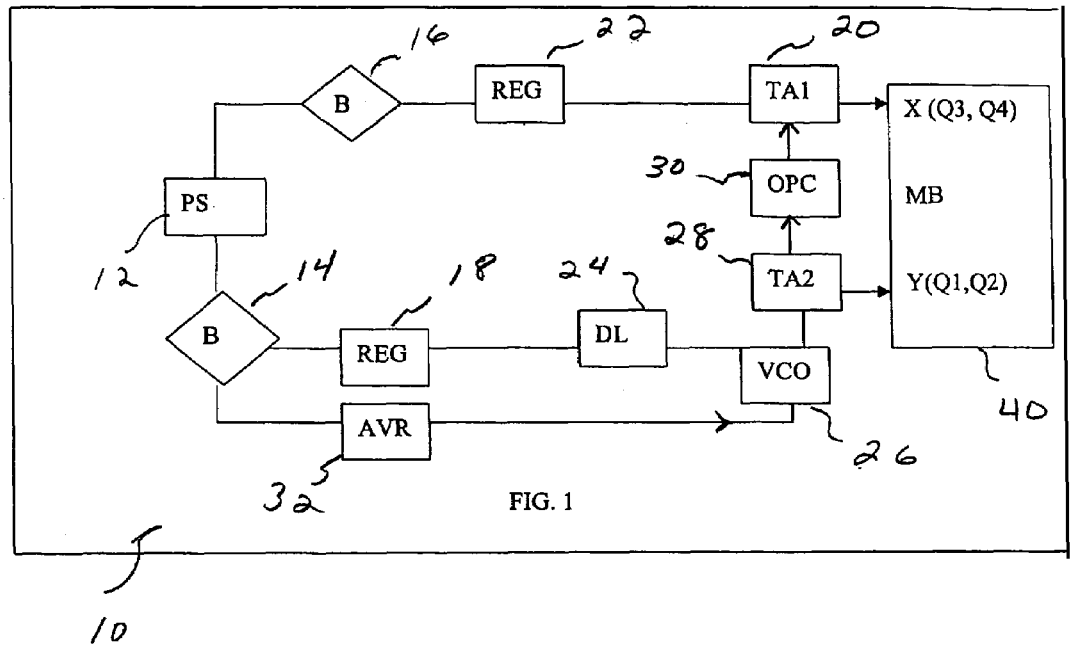
FIG. 1 is a block diagram of the dimmer circuit of the invention.
Figure 3A:
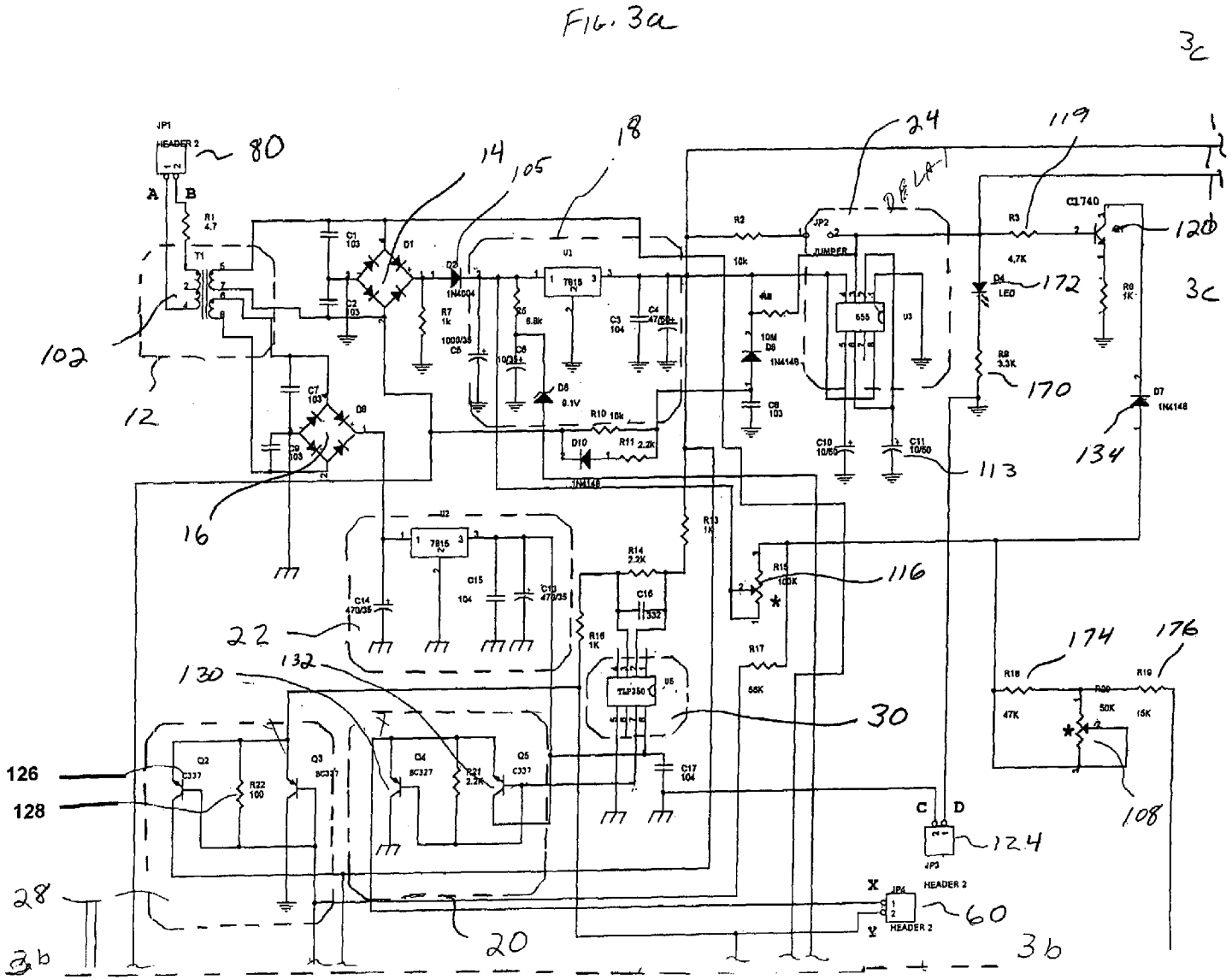
Figure 3B:
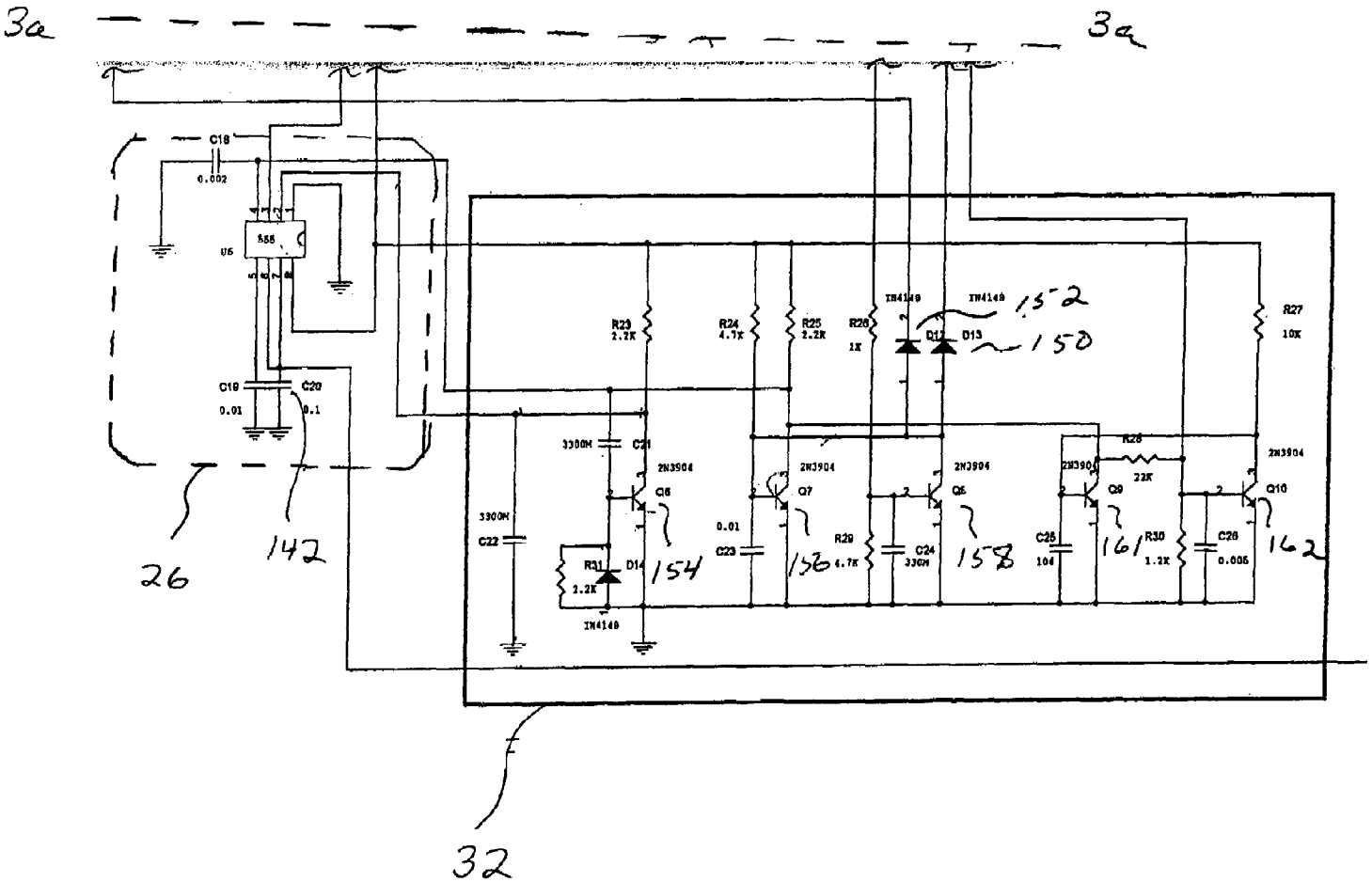
Figure 3E:
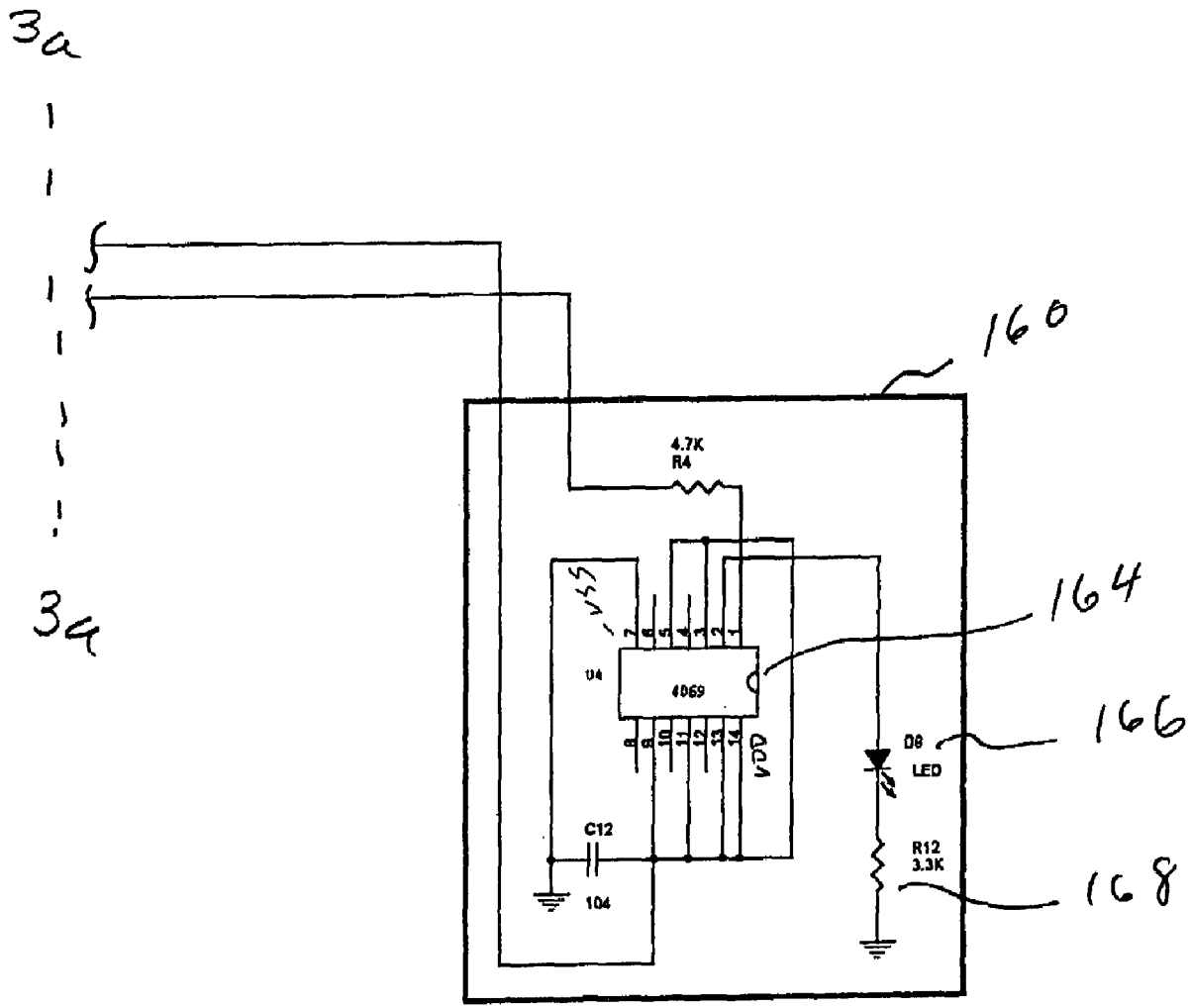

FIGS. 3*a*, 3*b* and 3*c* are schematic diagrams of the block diagram of FIG. 1.

Figure 4:
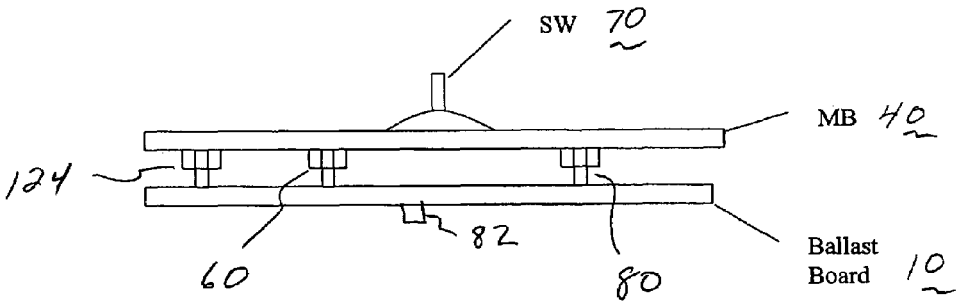

FIG. 4 is a diagram of an electrical fixture with the invention.

DETAILED DESCRIPTION

The low cost fluorescent lamp dimmer and ballast stabilizer circuit with which the present invention may be used will first be described in the block diagram of FIG. 1 and FIG. 2.

Referring to FIG. 1, the circuit 10 comprises an alternating current power supply 12, two bridge rectifiers 14 and 16 that convert ac to dc, two dc voltage regulators 18 and 22, an automatic voltage regulator (AVR) 32, a delay element 24, a voltage controlled oscillator (VCO) 26, opto-coupler 30 and two trigger amplifiers 20 and 28.

An alternating current power source is connected to the input ports of a power supply 12. The power supply is a transformer having two output ports sections. The first transformer output port section connects to the inputs of a first full wave bridge rectifier 14. The dc output of bridge rectifier 16 connects to a one voltage regulator 22 that supplies regulated power to one trigger amplifier (TA1) 20. The second transformer output port connects to the inputs of the second full wave bridge rectifier 14. The second full wave bridge rectifier 14 connects to a second voltage regulator 18 and to delay circuit 24 and to an opto-coupler 30. The output of the delay circuit 24 controls the initial operation of the VCO 26 as explained later AVR 32. Voltage regulator 18 supplies regulated power to a delay circuit 24, and to second trigger amplifier (TA) 28. The output of TA 28 drives a first pair of power semiconductor devices Q1, Q2, such as power MOSFETs or IGBTs that are carried on the main board 40. TA 28 is also connected to and drives the opto-coupler 30. The output of opto-coupler 30 drives the input of the other TA 20 whose output drives a second pair of power semiconductor devices Q3, Q4 such as power MOSFETs or IGBTs that are also carried on main board 40.

The operation of ballast circuit 10 and main board 40 are briefly described. An alternating current voltage source is applied to an input of power supply 12. Bridge rectifiers 14 and 12 at the output provide full wave rectified voltages to voltage regulators 18 and 22, respectively. The AVR circuit 32 provides a regulated operating voltage and triggering and reset signals to the VCO 26 whose output pulse width and duty cycle are set by a pair of variable resistors described below. The AVR 32 input is driven by two half wave rectified signals originating from bridge 14. The AVR circuit 32 compensates for voltage variations in the source of alternating current. The AVR 32 also shuts off the trigger circuits 20, 28 if a low voltage condition exits where ac power drops below 108 VAC.

The reset and trigger signals from AVR 32 provide a means for starting the VCO 26, which is configured as a mono-stable device. The trigger and reset signals switch with the cycling of the rectified waveforms originating from bridge 14. The oscillator 26 drives trigger amplifier 28, which in turn drives opto-coupler 30. Opto-coupler 30 provides current loop suppression and drives trigger amplifier 20. Trigger amplifier 20 outputs signal X and Y drive power transistors Q1-Q4 as described above which in turn drive the lamps (not shown).

Figure 2:
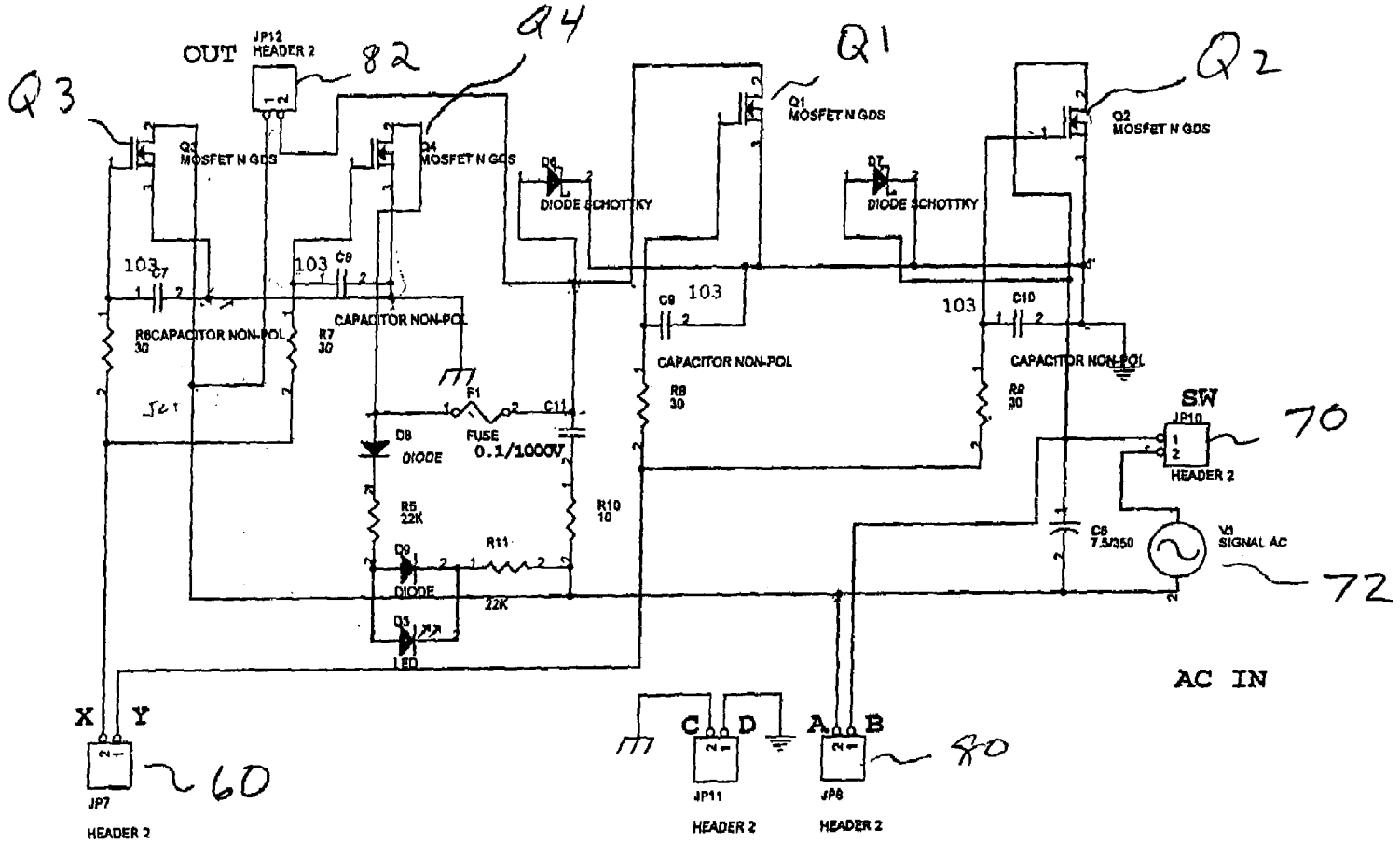
FIG. 2 is a schematic diagram of a power circuit for operating fluorescent lamps.

Referring to FIG. 2, a main board 40 has four power devices Q1-Q4, such as power MOSFETs (or IGBTs). The gates of devices Q3, Q4 are controlled by the X output on header 60 and the gates of the devices 46, 48 are controlled by the output Y of header 60. The lamp(s) are connected to pins 1, 2 of output header 82. A switch 70 connects a source of alternating current source 72 to the main board 40 and to the ballast board 10 via header 80. See FIGS. 3*a*, 3*b* and 3*c*. The ac power source 72 is connected to various resistors, capacitors and diodes to bias the power devices. Header 60 on main board 40 has pins X and Y connected to corresponding X, Y pins at header 60 on ballast board 10. Output header 82 is driven by devices power devices Q1-Q4 and supplies power the lamp(s).

A preferred embodiment of the ballast board is shown in FIGS. 3*a*, 3*b* and 3*c*. The power from the ac source 72 is applied at header 80 where the ac power is coupled to power supply 12 that includes transformer 102. Reduced voltage outputs of transformer 102 are via first and second full wave bridges 14, 16 first and second voltage regulators, 18, 22. Both regulators use a conventional integrated circuit such as model 7815 sold by various manufacturers. Voltage regulator 18 is connected to a delay circuit 24 that includes a timer that sets a delay for the VCO 26 and the dimmer. Delay circuit 24 controls transistor 120 which is connected via diode D7 and resistors R18, R19 to a control input to VCO 26. As long as transistor 120 is on, VCO 26 is off. This allows the current to heat the lamps for about four minutes and any other suitable time as set by delay circuit 24.

Delay circuit 24 powers up at startup and its output voltage on its pin 3 rises reaching its nominal voltage of 15V turning on the base of transistor 120 through resistor 119 and drives the collector of device 120 low. Simultaneously, LED 172 turns on through the biasing resistor 170. Inverter 164 turns off LED 166. LED 166 illuminates when the dimmer function engages. Diode 134 clamps the threshold and discharge pins (pins 6 and 7 respectively) allowing the VCO device 26 to switch at a 50% duty cycle that protects the lamps as they warm up. In practice, the VCO is implemented by configuring a KA555 integrated circuit to operate as a voltage controlled oscillator. Delay circuit 24 is also a KA555 that is configured to operate as a timer and to switch its output to a low value after about four minutes. The four-minute delay may me adjusted by changing the value of capacitor 113. When delay circuit 24 goes low, switching transistor 120 turns off and that allows the other KA555 device, VCO 26, to start switching with the duty cycle set by the threshold voltage on pin 6 of oscillator 26. Simultaneously LED 172 turns off and LED 166 turns on as the output pin 2 of inverter 164 goes high allowing current to flow through resister 168.

The switching characteristic of VCO 26 is determined by the value of variable resistors 116 and 118. They control pins 6 and 7 of device 26 and the voltage applied to the control signals connected to pins 2 and 4 on KA555 device 26.

The oscillator frequency of VCO 26 is controlled by the signals connected to pin 2 (the trigger input) and pin 4 (the reset) pin on KA555 device 26. Those pins are controlled by the AVR circuit 32. That circuit has five transistors, 154, 156, 158, 161 and 162. The collector of transistor 154 drives the trigger input of VCO 26 and the collectors of transistors 158 and 161 drive the reset input. The voltage applied to the shorted pins 6 and 7 of KA555 device 26 controls the pulse width of the oscillator. The rise time of this signal is set by variable resistor 108 and resistor 116 which provide course and fine resistance settings, respectively, and timing capacitor 142. The circuitry driving the trigger input on pin 2 of KA555 device 26 acts as a memory remembering the voltage characteristics of the previous voltages applied to bridge 16 via the transformer 102. Transistors 156 and 158 constitute a comparator circuit which increases the frequency of the VCO 26 when the voltage from the secondary side of transformer 102 decreases and conversely decreases the frequency of the VCO 26 when the voltage from the secondary side of transformer 16 increases.

The AVR 32 circuit maintains the circuit output voltage and allows it to vary no more than 2 to 2.3 V from nominal even if the input voltage at 82 increases to 160 VAC. The AVR 32 also shuts off the switching capability of oscillator 26 when the input voltage drops below 108 VAC. The AVR 32 maintains the output voltage regardless of the load.

The trigger and reset inputs to KA555 device 26 set the frequency of this oscillator. The pulse width of the oscillator is adjusted by the value of variable resistors 108 and 116 in conjunction with the value of the fixed resistors 174 and 176. Resistor 116 fine tunes the circuit and allows the dimmer circuit to be adjusted down to a voltage of 10V on the output of bridge 16 eliminating the occurrence of flickering or dropout. As previously mentioned the output pin 3 of oscillator 26 starts to oscillate at the dimming frequency after delay device 24 has turned off transistor 120.

The output of oscillator 26 drives the pair of transistors 126 and 128 directly which comprise trigger driver TA 28. The common signal connected to the emitters of transistor 126 and 128 provide push-pull driving capabilities to the Y port of header 60 as well as to the input to opto-coupler TLP250 30. Coupling device 30 and transistors 130 and 132 provide current loop suppression and current compensation. Transistors 130 and 132 together provide push-pull driving capabilities to pin X of header 122.

In operation, at power up, the voltage regulators 22, 18 provide controlled dc voltages to the integrated circuits, transistors and passive components that are carried on board 10. The delay circuit 24 keeps the VCO 26 idle for a set delay time to let the lamps warm up. Once the lamps are warm, the VCO 26 turns on and controls the frequency of the voltage across the lamps. The lamp frequency is important and the VCO 26 must operate over a large range of line voltages. The AVR 32 keeps the operating voltage of the VCO stable over large swings in the applied ac voltage. The VCO 26 controls the trigger circuit 28. That circuit in turn controls trigger circuit 20 through the opto-coupler 30. As such, the Y output of the ballast board 10 controls the X out. The two control outputs are applied to the main board 40. There the Y output is coupled to the gates of power semiconductor devices Q1 and Q3 and controls their operation. The X output is coupled to the gates of power semiconductor devices Q3 and Q4. The four power semiconductor devices supply power to the output header 82 that is connected to the fluorescent lamp.

One of the features of the invention is that two power devices are connected in parallel with the load and one of two power devices are alternately connected across the load. Turning to FIG. 2, on main board 40, Schottky diodes D6, D7 are in series with each other and are in series with the lamp header pin 2. The diodes D6, D7 are connected across power devices Q1, Q2, respectively. Both power devices are driven with the same gate signal Y. When switch 70 closes, ac power is connected to lamp header 82 via the series Schottky diodes and only one diode at a time is on. Since the diodes are across the devices, when one diode is on, its device is shorted and the power device of the off Schottky diode applies power to the lamp pin as a pulse width modulated power signal that is modulated by the Y control signal on the gate of the power device Q1 or Q2. For example, when the power from ac source 72 is positive, diode D7 is on, D6 is off and the power to pin 2 of header 82 is controlled by Q1. During a negative ac cycle, D7 is on and power to pin 2 is controlled by Q2.

Transistors Q3 and Q4 have one of their ends connected together and that connection is connected to ground. The other end of Q3 is connected to the other pin 1 of the header 82 and the other end of Q4 is connected via a fuse to the cathode of Schottky diode D6. In effect, the transistors Q3 and Q4 are connected across the load or header 82. The transistor Q3 and Q4 are driven by the X control signal that is simply the Y signal that is opto-coupled TA1 20.

In the preferred embodiment, the two boards and the switch are assembled together to fit inside a two gang electrical junction box. As shown in FIG. 4 the circuit boards attach to each other at their respective header pins and receptacles. The output 82 is connected to the one or more fluorescent lamps. The dimmer may be a conventional triac or a variable resistor. The triac or variable resistor is connected to and controlled by the manual switch 70 which may be a knob or lever that rotates between off, dimming and full on positions.

The invention claimed is:

1. A circuit for dimming a lamp comprising;

first and second rectifiers;

first and second voltage regulators coupled to the rectifiers for providing regulated voltage outputs;

a first gate control circuit coupled to the first voltage regulator;

a delay circuit coupled to the second voltage regulator;

a voltage controlled oscillator coupled to the second voltage regulator and to the delay circuit;

first and second gate control circuits coupled respectively to the first and second voltage regulator and to the oscillator for generating gate control signals in accordance with the oscillator output; and first and second pairs of gate controlled power semiconductor devices connected to the gate control circuits for supplying power to fluorescent lighting devices in accordance with the gate control signals.

2. The circuit of claim 1 wherein the first pair of gate controlled power semiconductor devices is connected in parallel with the lamp and each of the second pair of gate controlled power semiconductor devices are alternately connected across the lamp.

3. The circuit of claim 2 further comprising first and second diodes connected in series with each other at their anodes and each connected across one of the first pair of gate controlled power semiconductor devices.

4. The circuit of claim 3 further wherein the second pair of gate controlled power semiconductor devices are connected together and to ground at their common connection.

5. The circuit of claim 1 wherein the delay circuit disables the voltage controlled oscillator for preset period to time.

6. The circuit of claim 1 wherein the gate controlled power semiconductor devices are selected from the group consisting of power mosfets and insulated gate bipolar transistors.

7. The circuit of claim 1 wherein the rectifiers are full wave diode bridges.

8. The circuit of claim 1 further comprising an automatic voltage regulator coupled to the second voltage regulator and to the voltage controlled oscillator.

9. The circuit of claim 1 further comprising an optical coupler for coupling the output of the one gate control circuit to the other gate control circuit.

10. The circuit of claim 1 further comprising one or more variable resistors coupled between one of the voltage regulators and the oscillator for generating a voltage signal to control the frequency or duration of the gate control signal.

11. The circuit of claim 1 wherein the gate control circuits are push pull circuits.

12. An electrical device for controlling one or more fluorescent lamps comprising:

means for receiving an alternating current in input;

means for generating an output to dim a fluorescent lamp;

a first board for holding a ballast circuit;

a second board for holding power semiconductor devices;

a switch disposed on one of the boards and responsive to one or more applied mechanical forces for dimming one or more fluorescent lamps;

first and second rectifiers;

first and second voltage regulators coupled to the rectifiers for providing regulated voltage outputs;

a first gate control circuit coupled to the first voltage regulator;

a delay circuit coupled to the second voltage regulator;

a voltage controlled oscillator coupled to the second voltage regulator and to the delay circuit;

first and second gate control circuits coupled respectively to the first and second voltage regulator and to the oscillator for generating gate control signals in accordance with the oscillator outputs; and first and second pairs of gate controlled power semiconductor devices connected to the gate control circuits for supplying power to fluorescent lighting devices in accordance with the gate control signals and one or more variable resistors coupled between one of the voltage regulators and the oscillator for generating a voltage signal to control the frequency or duration of the gate control signal.

* * * * *